US010373777B1

(12) United States Patent
Lin et al.

(10) Patent No.: US 10,373,777 B1
(45) Date of Patent: Aug. 6, 2019

(54) KEYBOARD

(71) Applicant: Chicony Electronics Co., Ltd., New Taipei (TW)

(72) Inventors: Chih-Ping Lin, New Taipei (TW); Kuang-Shen Uang, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/163,553

(22) Filed: Oct. 17, 2018

(30) Foreign Application Priority Data

Aug. 20, 2018 (TW) ..... 107129005 A

(51) Int. Cl.
*H01H 13/7065* (2006.01)
*H01H 13/84* (2006.01)

(52) U.S. Cl.
CPC ..... *H01H 13/7065* (2013.01); *H01H 13/84* (2013.01); *H01H 2221/058* (2013.01); *H01H 2221/062* (2013.01); *H01H 2227/028* (2013.01); *H01H 2227/03* (2013.01)

(58) Field of Classification Search
CPC ..... H01H 9/26; H01H 13/72; H01H 25/00; H01H 25/04; H01H 1/02; H01H 13/14; H01H 13/70; H01H 3/125; H01H 13/83; H01H 13/705; H01H 13/7065; H01H 13/84; H01H 2221/058; H01H 2221/062; H01H 2227/028; H01H 2227/03
See application file for complete search history.

(56) References Cited

U.S. PATENT DOCUMENTS 5,504,283 A * 4/1996 Kako ..... H01H 3/125 200/344
5,657,860 A * 8/1997 Koike ..... H01H 3/125 200/344
5,821,482 A * 10/1998 Ootani ..... H01H 13/705 200/5 A
5,901,837 A * 5/1999 Aimi ..... H01H 3/125 200/344
6,586,695 B2 * 7/2003 Sato ..... H01H 3/122 200/344
6,613,996 B2 * 9/2003 Lee ..... H01H 3/125 200/344
6,781,077 B2 * 8/2004 Olodort ..... H01H 3/125 200/344
7,994,446 B2 * 8/2011 Chao ..... H01H 3/125 200/344

(Continued)

FOREIGN PATENT DOCUMENTS

TW 201804497 A 2/2018

*Primary Examiner* — Ahmed M Saeed
(74) *Attorney, Agent, or Firm* — CKC & Partners Co., LLC

(57) ABSTRACT

A keyboard includes a base plate, a keycap, and at least one balance assembly. The base plate has a plurality of connecting structures. The keycap is above the base plate. The balance assembly includes a balance bar and two silencing members. The balance bar is between the base plate and the keycap and is engaged with the keycap. The silencing members are connected to the balance bar and engaged with the connecting structures. The balance assembly is configured to guide the keycap to move relative to the base plate. Hardnesses of the base plate and the balance bar are greater than a hardness of the silencing members.

9 Claims, 7 Drawing Sheets

(56) References Cited

U.S. PATENT DOCUMENTS

| | | | | |
|---|---|---|---|---|
| 8,410,385 | B2 * | 4/2013 | Dai | H01H 23/02 200/296 |
| 9,697,965 | B2 * | 7/2017 | Chen | H01H 13/705 |
| 2011/0297525 | A1 * | 12/2011 | Tsai | H01H 13/705 200/517 |
| 2013/0121017 | A1 * | 5/2013 | Tsai | G06F 3/0202 362/602 |
| 2013/0134022 | A1 * | 5/2013 | Liang | H01H 13/705 200/5 A |

* cited by examiner

100

KEYBOARD

CROSS-REFERENCE TO RELATED APPLICATION

This application claims priority to Taiwan Application Serial Number 107129005, filed Aug. 20, 2018, which is herein incorporated by reference.

BACKGROUND

Technical Field

The present disclosure relates to a keyboard.

Description of Related Art

Currently, the keyswitch device is one of the indispensable input devices to enter text or numbers while using a personal computer (PC). Moreover, consumer electronic products used in daily life or large-scale processing equipment used in the industrial sector require key structure units as input devices to be operated.

For keys on a keyboard, in order to guide keycaps to vertically move, each key is usually equipped with a linking member under the keycap thereof. For example, a conventional scissors-like linking member is consisted of two linking members connected in an interlaced manner. In addition, in order to balance a force applied onto a multiple key, the multiple key is usually equipped with a balance bar under the keycap thereof. Therefore, no matter being applied close to an edge or a corner of the keycap, the force can be evenly distributed on the whole surface of the keycap.

In general, the above-mentioned balance bar is usually fixed in the keyboard by engaging hooks on the base plate. A conventional method of fabricating hooks on a base plate is performing a stamping process to a sheet metal piece, so as to obtain the hooks that bend relative to the base plate. However, the foregoing base plate and the balance bar are generally metal materials. As a result, metal knock noises will be produced when using the keyboard.

Accordingly, how to provide a keyboard to solve the aforementioned problems becomes an important issue to be solved by those in the industry.

SUMMARY

An aspect of the disclosure is to provide a keyboard that can efficiently solve the aforementioned problems.

According to an embodiment of the disclosure, a keyboard includes a base plate, a keycap, and at least one balance assembly. The base plate has a plurality of connecting structures. The keycap is above the base plate. The balance assembly includes a balance bar and two silencing members. The balance bar is between the base plate and the keycap and is engaged with the keycap. The silencing members are connected to the balance bar and engaged with the connecting structures. The balance assembly is configured to guide the keycap to move relative to the base plate. Hardnesses of the base plate and the balance bar are greater than a hardness of the silencing members.

In an embodiment of the disclosure, the balance bar includes a first bar body and two second bar bodies connected to and bended relative to the first bar body. The first bar body is engaged with the keycap. Each of the silencing members includes a main portion and at least one shaft portion. The main portion is sleeved onto an end of a corresponding one of the second bar bodies away from the first bar body. Said at least one shaft portion is connected to the main portion and slidably engaged with a corresponding one of the connecting structures.

In an embodiment of the disclosure, the shaft portions of the silencing members are substantially parallel to the first bar body.

In an embodiment of the disclosure, the shaft portions of the silencing members are substantially extended away from each other relative to the second bar bodies.

In an embodiment of the disclosure, the shaft portions of the silencing members are substantially extended toward each other relative to the second bar bodies.

In an embodiment of the disclosure, a number of said at least one shaft portion is two. The main portion is between two of the connecting structures. The two shaft portions are at opposite sides of the main portion and slidably engaged with said two of the connecting structures respectively.

In an embodiment of the disclosure, the main portion is slidably sleeved onto said end of said corresponding one of the second bar bodies away from the first bar body.

In an embodiment of the disclosure, the main portion has a channel having two open ends. Said corresponding one of the second bar bodies inserts into the channel from one of said two open ends.

In an embodiment of the disclosure, a number of said at least one balance assembly is two. The two balance assemblies are arranged in a horizontally symmetrical manner relative to the base plate.

In an embodiment of the disclosure, the keyboard further includes a linking member engaged between the base plate and the keycap and configured to guide the keycap to move toward and away from the base plate. Said two balance assemblies surround the linking member.

Accordingly, in the keyboard of the present disclosure, the balance bar of the balance assembly is engaged with the connecting structures on the base plate through the silencing members without directly contacting the connecting structures, so as to effectively avoid producing noise of metal impact while pressing the keycap. In addition, by making the silencing members be slidably sleeved onto the balance bar (i.e., they are not fixed to each other), the interference between the silencing members and the balance bar can be avoided during the sliding of the silencing members relative to the connecting structures, and the problem of structural interference between the balancing assembly and other components can be effectively avoid when the keycap is pressed.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
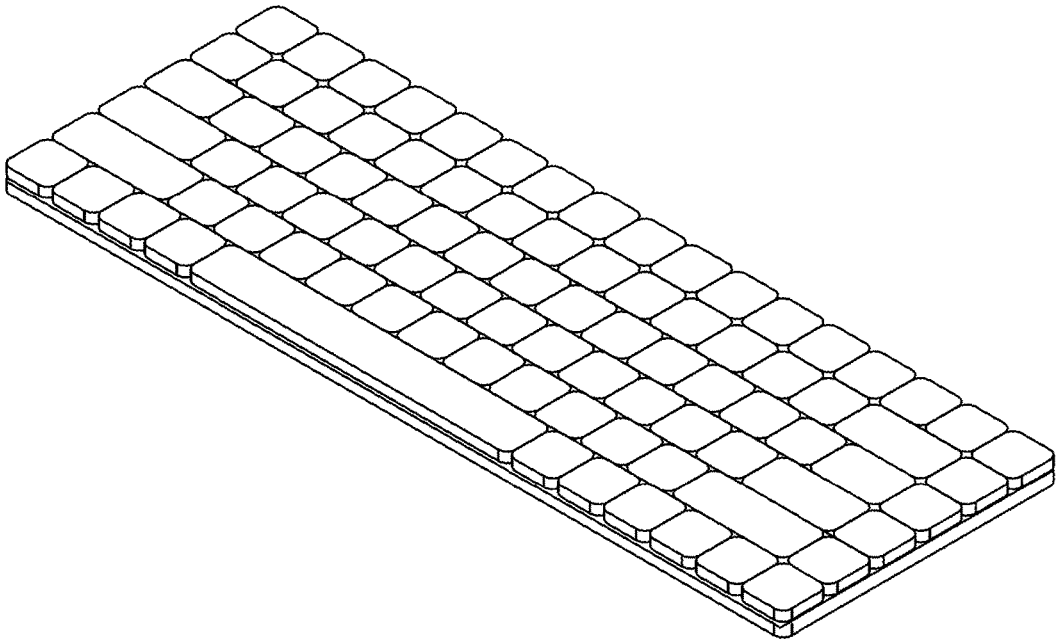
FIG. 1 is a perspective view of a keyboard according to some embodiments of the disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Reference is made to FIG. 1. FIG. 1 is a perspective view of a keyboard 100 according to some embodiments of the disclosure. As shown in FIG. 1, the keyboard 100 of the disclosure can be an external keyboard (e.g., a keyboard with a PS/2 interface or a keyboard with a USB interface) used in a desktop computer, or can be a part of a computer system having an input device that is in the form of a keyswitch, but the disclosure is not limited in this regard. That is, concepts of the keyboard 100 of the disclosure can be used in any electronic product that performs input function by pressing.

Figure 2A:
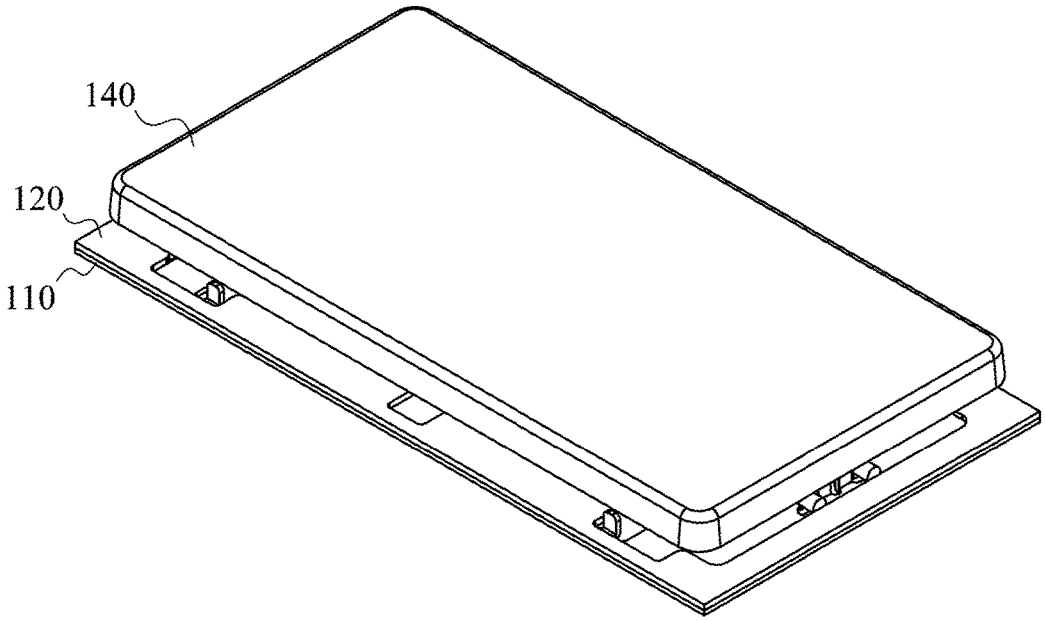
FIG. 2A is a perspective view of a keyswitch device of the keyboard shown in FIG. 1.
Figure 2B:
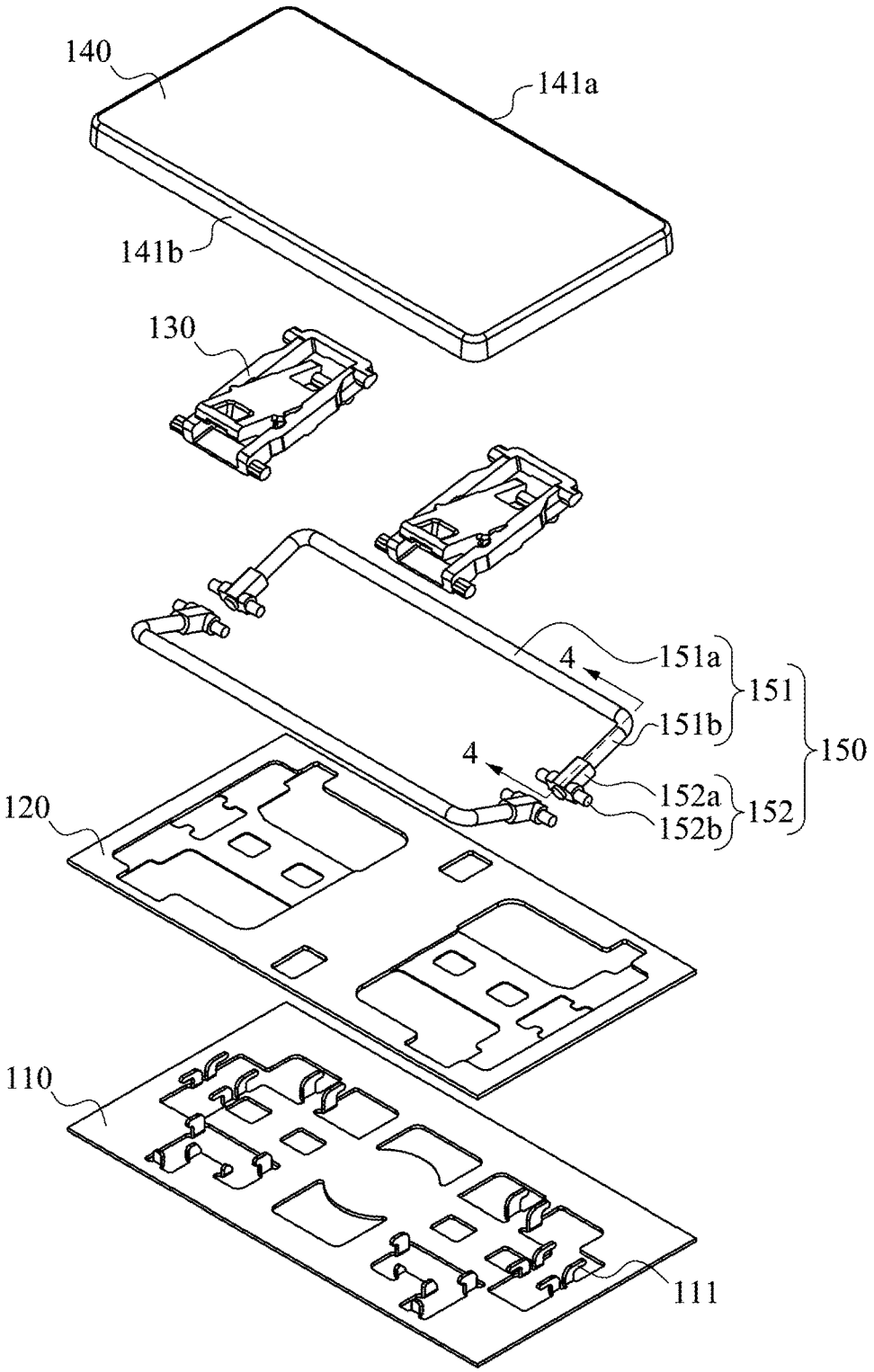
FIG. 2B is an exploded view of the keyswitch device shown in FIG. 2A.
Figure 3A:
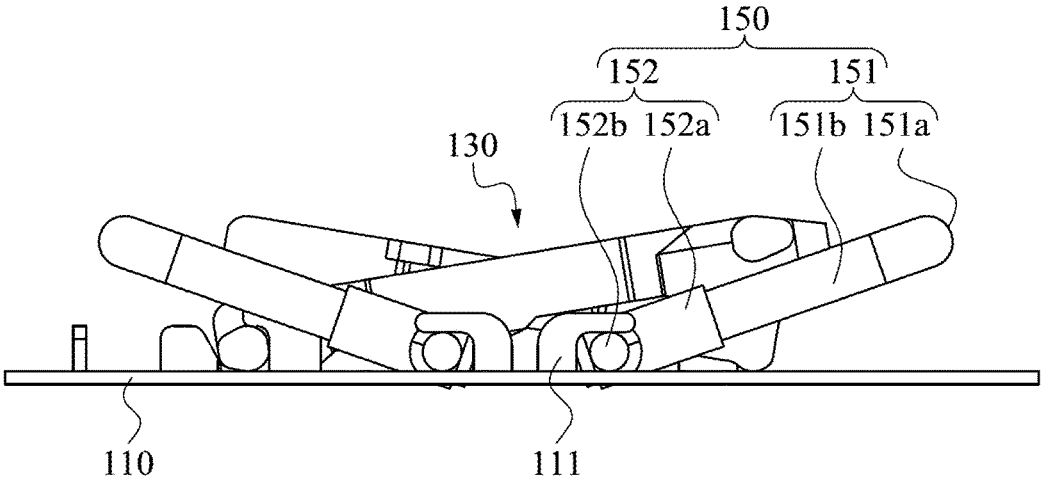
FIG. 3A is a side view of some components of the keyswitch device shown in FIG. 2A in an operating state.
Figure 3B:
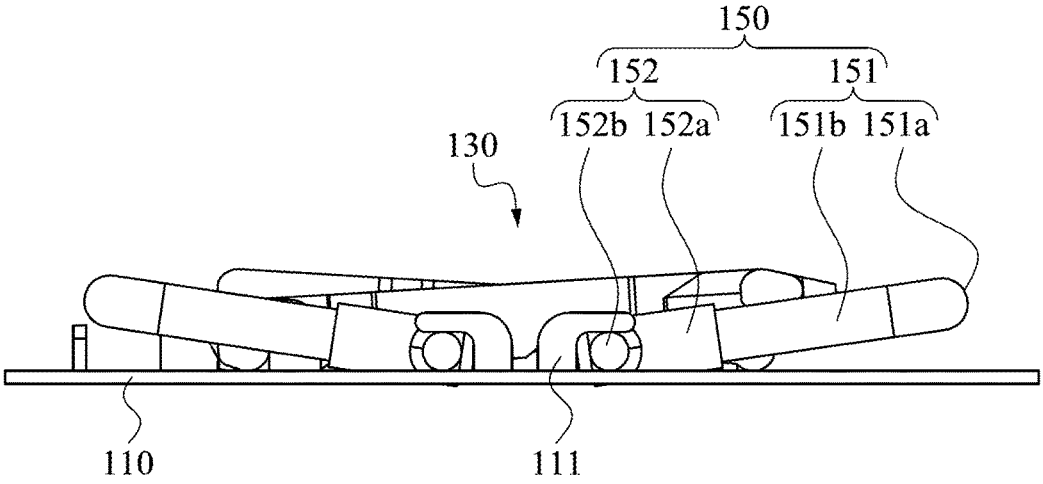
FIG. 3B is a side view of some components of the keyswitch device shown in FIG. 2A in another operating state.

Reference is made to FIGS. 2A-3B. FIG. 2A is a perspective view of a keyswitch device of the keyboard 100 shown in FIG. 1. FIG. 2B is an exploded view of the keyswitch device shown in FIG. 2A. FIG. 3A is a side view of some components of the keyswitch device shown in FIG. 2A in an operating state. FIG. 3B is a side view of some components of the keyswitch device shown in FIG. 2A in another operating state. Structures and functions of components included in the keyboard 100 and connection and operation relationships among these components are described in detail below.

As shown in FIGS. 1-3B, in the present embodiment, the keyboard 100 includes a base plate 110, a circuit board 120, a plurality of linking members 130 (only one of which is representatively labelled), a plurality of keycaps 140, and a plurality of balance assemblies 150 (only one of which is representatively labelled in FIG. 2B), in which a combination of the base plate 110, the circuit board 120, two of the linking members 130, one of the keycap 140, and two of the balance assemblies 150 can be regarded as an independent keyswitch device, but the disclosure is not limited in this regard. The base plate 110 has a plurality of connecting structures 111 (only one of which is representatively labelled in FIG. 2B). In the present embodiment, the connecting structures 111 are hooks formed on the base plate 110 by stamping, but the disclosure is not limited in this regard. The keycap 140 is disposed above the base plate 110. The circuit board 120 is disposed on the base plate 110 and between the base plate 110 and the keycap 140. The linking members 130 and the balance assemblies 150 are between the base plate 110 and the keycap 140. Each of upper ends of the linking members 130 and upper ends of the balance assemblies 150 is engaged with the keycap 140. The connecting structures 111 of the base plate 110 pass through the circuit board 120 to be engaged with each of lower ends of the linking members 130 and lower ends of the balance assemblies 150. The linking members 130 and the balance assemblies 150 are configured to guide the keycap 140 to move relative to the base plate 110. In addition, as shown in FIG. 2B, the balance assemblies 150 extend along long sides of the keycap 140 (i.e., sides 141*a*, 141*b*) to two short sides. Therefore, a more balanced linkage effect can be provided for edges or corners of the keycap 140, and a force can be spread evenly over an entire surface of the keycap 140.

As shown in FIGS. 2B-3B, in the present embodiment, the linking members 130 are scissors-like linkage assemblies for example, but the disclosure is not limited in this regard. In practical applications, the linking members 130 can be replaced by other structures having similar functions (i.e., moving the keycap 140 relative to the base plate 110), such as V-shaped linkage structures (i.e., butterfly hinges), A-shaped linkage structures, or linkage structures each has two parallel linkages.

In some embodiments, the keyswitch device of the keyboard 100 can further includes a restoring member (not shown). The restoring member can be disposed between the circuit board 120 and the keycap 140. When the keycap 140 is pressed downwards by an external force, the restoring member generates a counterforce to the keycap 140 so as to provide users the feeling of pressing, and the pressed keycap 140 moves to its lowest position with the guidance of the linking members 130 and the balance assemblies 150. When the external force applied onto the keycap 140 is released, the restoring member can provide a restoring force for returning the keycap 40 back to its highest position at which the keycap 140 is not pressed. The mechanism and principle of producing a trigger signal by pressing the keyswitch device can be referred to relevant prior arts and is not introduced here for simplicity. In some embodiments, the restoring member is a resilient member, such as a rubber dome, but the disclosure is not limited in this regard. In practical applications, the restoring member can be replaced by other component having similar functions, such as a metal dome, a spring, a mechanical switch, a magnetic component, etc.

As shown in FIGS. 2B-3B, in the present embodiment, each of the balance assemblies 150 includes a balance bar 151 and two silencing members 152 (only one of which is representatively labelled in FIG. 2B). The balance bar 151 is between the base plate 110 and the keycap 140 and is engaged with the keycap 140. The silencing members 152 are connected to the balance bar 151 and engaged with the connecting structures 111 on the base plate 110. Specifically, the balance bar 151 includes a first bar body 151*a* and two second bar bodies 151*b* that are connected to and bended relative to the first bar body 151*a*. The second bar bodies 151*b* are respectively connected to two ends of the first bar body 151*a*. The first bar body 151*a* is engaged with the keycap 140. For example, the keycap 140 can have a plurality of engaging portions (not shown) at the bottom thereof, and the engaging portions are respectively engaged with plurality of portions of the first bar body 151*a*, so as to increase the connection stability between the keycap 140 and the first bar body 151*a*. In some embodiments, the first bar body 151*a* is pivotally connected to the keycap 140, but the disclosure is not limited in this regard.

In the present embodiment, each of the silencing members 152 includes a main portion 152*a* and two shaft portions 152*b*. The main portion 152*a* is sleeved onto an end of a corresponding one of the second bar bodies 151*b* away from the first bar body 151*a*, and is between said two connecting structures 111. Said two shaft portions 152*b* are respectively connected opposite sides of the main portion 152*a*. In the present embodiment, said two shaft portions 152*b* are slidably engaged with the connecting structures 111 respectively, but the disclosure is not limited in this regard. In some embodiments, said two shaft portions 152*b* can be pivotally connected to the connecting structures 111 respectively.

In some embodiments, in order to provide the keyboard 100 with enough structural strength, a hardness of the material of the base plate 110 and a hardness of the material of the balance bar 151 are greater than a hardness of the material of the silencing members 152. In some embodiments, the material of the base plate 110 and the material of the balance bar 151 include metals, and the material of the silencing members 152 includes plastic, but the disclosure is not limited in this regard.

With the foregoing structural configurations, it can be ensured that the balance bar 151 of the balance assembly 150 is engaged with the connecting structures 111 on the base plate 110 through the silencing members 152 without directly contacting the connecting structures 111, so as to effectively avoid producing noise of metal impact while pressing the keycap 140.

Figure 4:
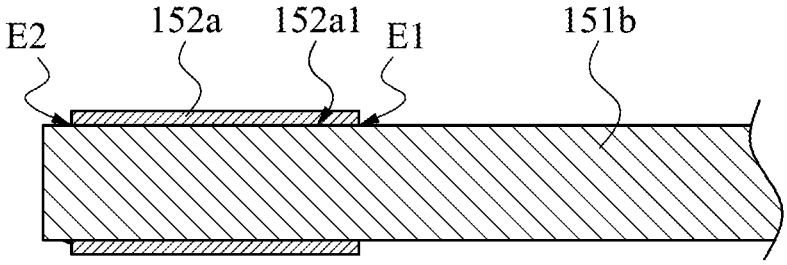
FIG. 4 is a partial cross-sectional view of a balance assembly shown in FIG. 2B taken along line 4-4.

Reference is made to FIG. 4. FIG. 4 is a partial cross-sectional view of a balance assembly 150 shown in FIG. 2B taken along line 4-4. As shown in FIG. 4, in the present embodiment, the main portion 152*a* of the silencing member 152 has a channel 152*a*1 having two open ends E1, E2. The corresponding one of the second bar bodies 151*b* inserts into the channel 152*a*1 from the open end E1 and protrudes out from the open end E2. However, the disclosure is not limited in this regard. In some other embodiments, the main portion 152*a* of the silencing member 152 can only have a single open end E1 for the second bar body 151*b* to insert into.

In some embodiments, the silencing member 152 is formed at the end of the second bar body 151*b* away from the first bar body 151*a* by an injection molding process.

In some other embodiments, the main portion 152*a* of the silencing member 152 is slidably sleeved onto the end of the second bar body 151*b* away from the first bar body 151*a* (i.e., the silencing member 152 and the second bar body 151*b* are not fixed to each other). With the structural configurations, the interference between the silencing members 152 and the balance bar 151 can be avoided during the sliding of the silencing members 152 relative to the connecting structures 111, and the problem of structural interference between the balancing assembly 150 and other components can be effectively avoid when the keycap 140 is pressed.

As shown in FIG. 2B, in the present embodiment, the shaft portions 152*b* in the same balancing assembly 150 are substantially parallel to the first bar body 151*a*. The two silencing members 152 of each of the balancing assemblies 150 have four shaft portions 152*b*, in which two of the shaft portions 152*b* are inwardly extended toward each other, and the other two of the shaft portions 152*b* are outwardly extended away from each other. The four shaft portions 152*b* are slidably engaged with four of the connecting structures 111 on the base plate 110 respectively, so as to increase the connection stability between the balancing assemblies 150 and the base plate 110. However, the disclosure is not limited by the present embodiment.

Figure 5:
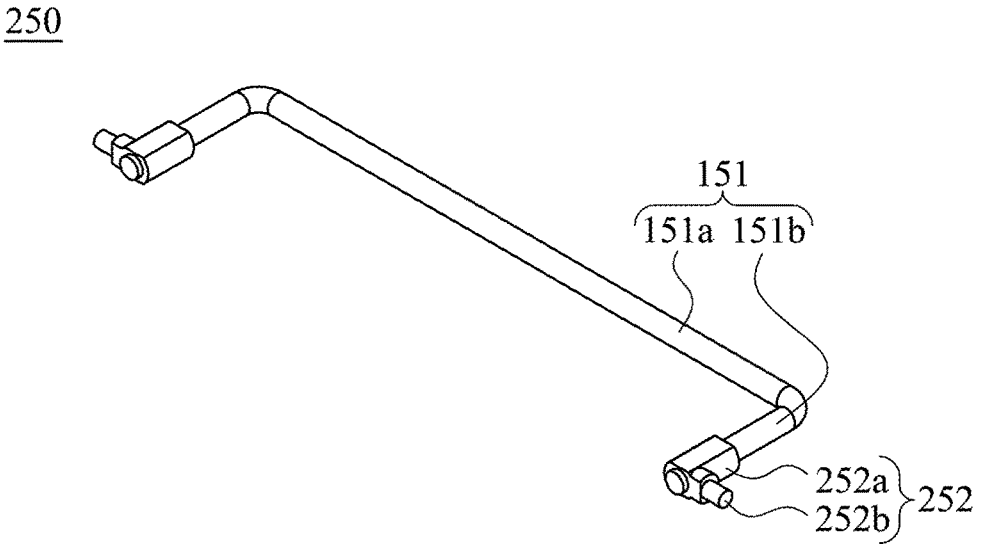
FIG. 5 is a perspective view of a balance assembly according to some embodiments of the disclosure.

Reference is made to FIG. 5. FIG. 5 is a perspective view of a balance assembly 250 according to some embodiments of the disclosure. In the present embodiment, the balance assembly 250 includes a balance bar 151 and two silencing members 252, in which the balance bar 151 is identical or similar to that in the embodiment of FIG. 2B, so the introduction of the balance bar 151 can be referred to the above related description without repeating here for simplicity. Differences between the present embodiment and the embodiment of FIG. 2B is that each of the silencing members 252 of the present embodiment only includes one shaft portion 252*b* connected to a main portion 252*a*, and that the first bar body 151*a* and any of the shaft portions 252*b* are substantially extended away from each other relative to the second bar bodies 151*b*. That is, the two shaft portions 252*b* of the two silencing members 252 are outwardly extended away from each other relative to the balance bar 151. To engage the balance assembly 250 of the present embodiment, the base plate 110 shown in FIG. 2B can correspondingly omit two of the connecting structures 111.

Figure 6:
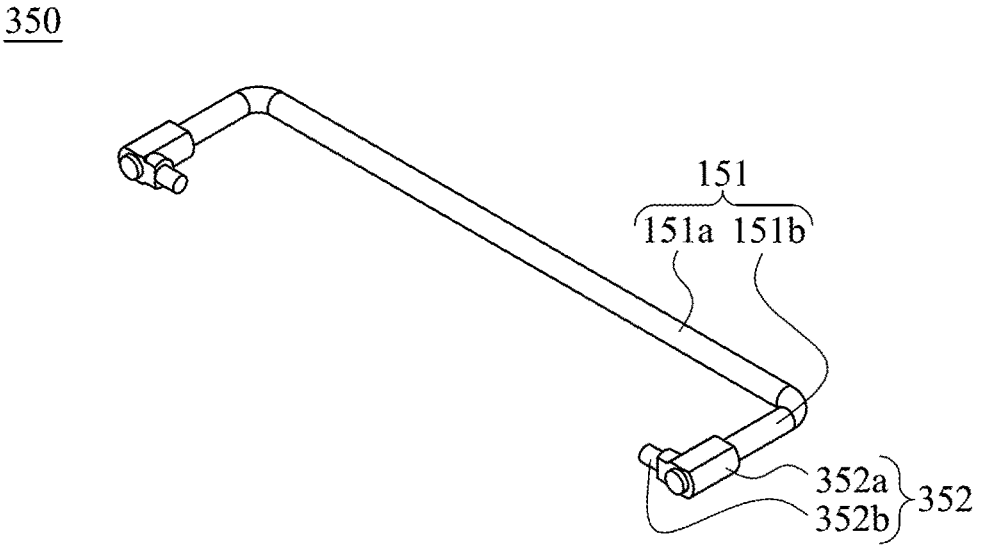
FIG. 6 is a perspective view of a balance assembly according to some embodiments of the disclosure.

Reference is made to FIG. 6. FIG. 6 is a perspective view of a balance assembly 350 according to some embodiments of the disclosure. In the present embodiment, the balance assembly 250 includes a balance bar 151 and two silencing members 352, in which the balance bar 151 is identical or similar to that in the embodiment of FIG. 2B, so the introduction of the balance bar 151 can be referred to the above related description without repeating here for simplicity. Differences between the present embodiment and the embodiment of FIG. 2B is that each of the silencing members 352 of the present embodiment only includes one shaft portion 352*b* connected to a main portion 352*a*, and that the first bar body 151*a* and any of the shaft portions 352*b* are substantially extended toward each other relative to the second bar bodies 151*b*. That is, the two shaft portions 352*b* of the two silencing members 352 are inwardly extended toward each other relative to the balance bar 151. To engage the balance assembly 350 of the present embodiment, the base plate 110 shown in FIG. 2B can correspondingly omit two of the connecting structures 111.

As shown in FIGS. 3A and 3B, in the present embodiment, the connecting structures 111 engaged with the two balancing assemblies 150 are between the two balancing assemblies 150, and the two balancing assemblies 150 are arranged in a horizontally symmetrical manner relative to the base plate 110. However, the disclosure is not limited in this regard.

Figure 7A:
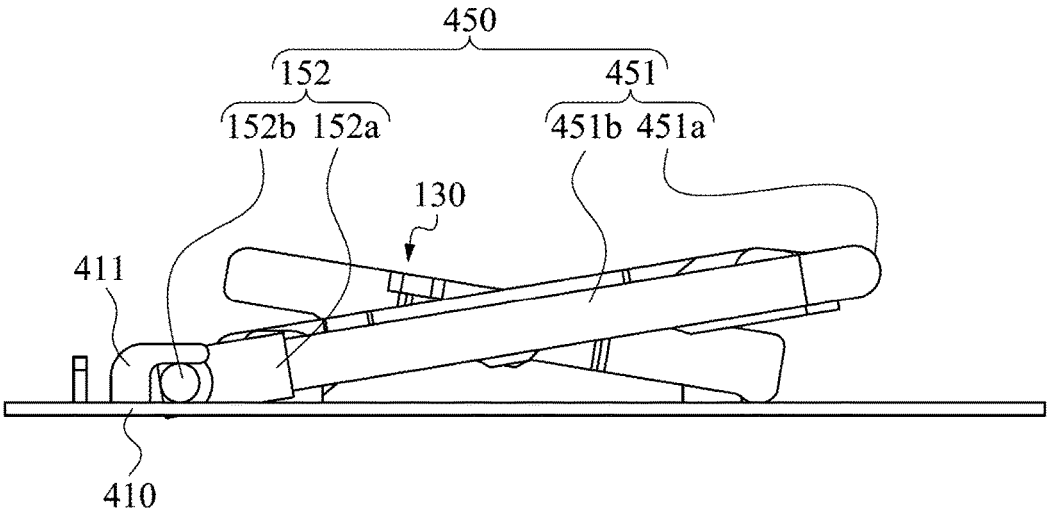
FIG. 7A is a side view of some components of a keyswitch device in an operating state according to some embodiments of the disclosure.
Figure 7B:
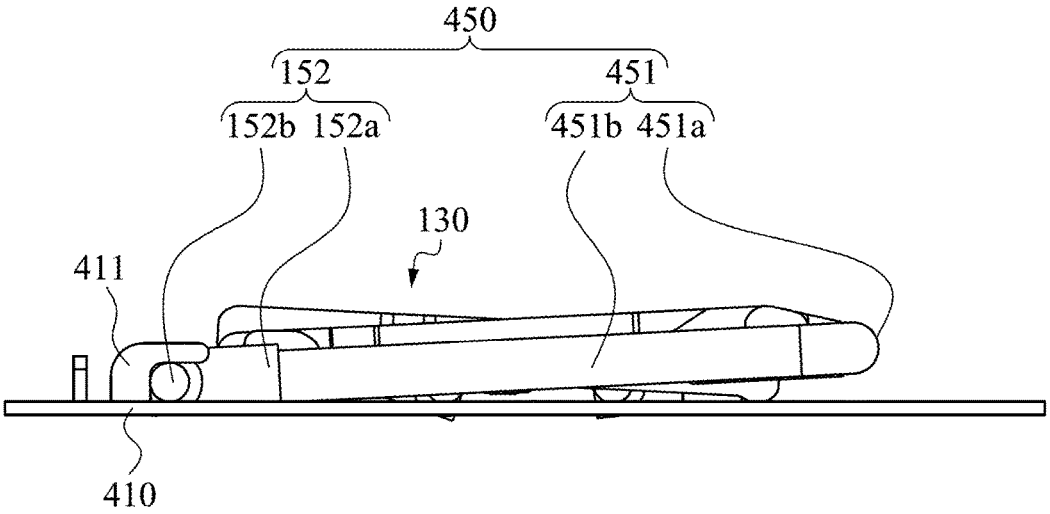
FIG. 7B is a side view of some components of the keyswitch device in another operating state according to some embodiments of the disclosure.

Reference is made to FIGS. 7A and 7B. FIG. 7A is a side view of some components of a keyswitch device in an operating state according to some embodiments of the disclosure. FIG. 7B is a side view of some components of the keyswitch device in another operating state according to some embodiments of the disclosure. In the present embodiment, the keyswitch device includes a base plate 410, a circuit board 120 (can be referred to FIG. 2B without drawing), linking members 130, a keycap 140 (can be referred to FIG. 2B without drawing), and a balancing assembly 450, in which the circuit board 120, two linking members 130, the keycap 140, and the silencing members 152 in the balancing assembly 450 are identical or similar to those in the embodiment of FIG. 2B, so the introductions of these components can be referred to the above related description without repeating here for simplicity. Differences between the present embodiment and the embodiment of FIG. 2B is that the keyswitch device of the present embodiment only includes the single balancing assembly 450, and that the first bar body 451*a* and the silencing members 152 are respectively adjacent to two long sides of the keycap 140 (i.e., respectively adjacent to the bottoms of the two sides 141*a*, 141*b* of the keycap 140). In addition, the positions of connecting structures 411 on the base plate 410 also need to be adjusted corresponding to the positions of the silencing members 152. Therefore, second bar bodies 451*b* of balance bar 451 of the present embodiment is longer than the second bar bodies 151*b* of the balance bars 151 in FIG. 2B, but the balancing assembly 450 of the present embodiment can still achieve the purpose of guiding the keycap 140 to move relative to the base plate 410.

According to the foregoing recitations of the embodiments of the disclosure, it can be seen that in the keyboard of the present disclosure, the balance bar of the balance assembly is engaged with the connecting structures on the base plate through the silencing members without directly contacting the connecting structures, so as to effectively avoid producing noise of metal impact while pressing the keycap. In addition, by making the silencing members be slidably sleeved onto the balance bar (i.e., they are not fixed to each other), the interference between the silencing members and the balance bar can be avoided during the sliding of the silencing members relative to the connecting structures, and the problem of structural interference between the balancing assembly and other components can be effectively avoid when the keycap is pressed.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyboard, comprising:

a base plate having a plurality of connecting structures;

a keycap above the base plate; and at least one balance assembly comprising:

a balance bar between the base plate and the keycap and engaged with the keycap, wherein the balance bar comprises a first bar body and two second bar bodies connected to and bended relative to the first bar body, and the first bar body is engaged with the keycap; and two silencing members connected to the balance bar and engaged with the connecting structures, the balance assembly being configured to guide the keycap to move relative to the base plate, wherein hardnesses of the base plate and the balance bar are greater than a hardness of the silencing members, wherein each of the silencing members comprises:

a main portion sleeved onto an end of a corresponding one of the second bar bodies away from the first bar body; and at least one shaft portion connected to the main portion and slidably engaged with a corresponding one of the connecting structures.

2. The keyboard of claim 1, wherein the shaft portions of the silencing members are substantially parallel to the first bar body.

3. The keyboard of claim 1, wherein the shaft portions of the silencing members are substantially extended away from each other relative to the second bar bodies.

4. The keyboard of claim 1, wherein the shaft portions of the silencing members are substantially extended toward each other relative to the second bar bodies.

5. The keyboard of claim 1, wherein a number of said at least one shaft portion is two, the main portion is between two of the connecting structures, and the two shaft portions are at opposite sides of the main portion and slidably engaged with said two of the connecting structures respectively.

6. The keyboard of claim 1, wherein the main portion is slidably sleeved onto said end of said corresponding one of the second bar bodies away from the first bar body.

7. The keyboard of claim 1, wherein the main portion has a channel having two open ends, and said corresponding one of the second bar bodies inserts into the channel from one of said two open ends.

8. The keyboard of claim 1, wherein a number of said at least one balance assembly is two, and the two balance assemblies are arranged in a horizontally symmetrical manner relative to the base plate.

9. The keyboard of claim 8, further comprising a linking member engaged between the base plate and the keycap and configured to guide the keycap to move toward and away from the base plate, wherein said two balance assemblies surround the linking member.

* * * * *